US006641293B2

(12) United States Patent
Kumar et al.

(10) Patent No.: US 6,641,293 B2
(45) Date of Patent: Nov. 4, 2003

(54) LIGHT SHIELD WITH REFLECTIVE INNER SURFACE

(75) Inventors: Arun Kumar, Farmington Hills, MI (US); Jeyachandrabose Chinniah, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/001,746

(22) Filed: Oct. 31, 2001

(65) Prior Publication Data

US 2003/0081425 A1 May 1, 2003

(51) Int. Cl.[7] ..... F21V 7/22
(52) U.S. Cl. ..... 362/539; 362/298; 362/303
(58) Field of Search ..... 362/539, 298, 362/303, 459, 482, 506, 507, 509, 538, 257, 296, 297, 304, 305, 341, 345, 350

(56) References Cited

U.S. PATENT DOCUMENTS

| | | | | | |
|---|---|---|---|---|---|
| 1,110,955 | A | * | 9/1914 | Matisse et al. | 362/303 |
| 1,232,046 | A | * | 7/1917 | Kleinert | 362/303 |
| 1,533,615 | A | * | 4/1925 | Schwartz | 362/305 |
| 1,647,613 | A | | 11/1927 | Fredette | |
| 1,835,745 | A | * | 12/1931 | Barbian | 362/539 |
| 3,302,015 | A | * | 1/1967 | Dahlke | 362/298 |
| 3,749,906 | A | | 7/1973 | Thiry | |
| 3,754,135 | A | * | 8/1973 | Hulbert, Jr. | 362/303 |
| 4,587,601 | A | | 5/1986 | Collins | |
| 4,654,758 | A | | 3/1987 | Székács | |
| 4,755,916 | A | | 7/1988 | Collins | |
| 4,800,467 | A | | 1/1989 | Lindae et al. | |
| 5,618,102 | A | * | 4/1997 | Ferrell | 362/298 |
| 6,012,830 | A | | 1/2000 | Fraizer | |
| 6,079,860 | A | | 6/2000 | Ito | |
| 6,132,068 | A | * | 10/2000 | Katsumata | 362/539 |
| 6,170,970 | B1 | * | 1/2001 | Eto | 362/539 |
| 6,422,726 | B1 | * | 7/2002 | Tatsukawa et al. | 362/539 |
| 6,450,670 | B1 | * | 9/2002 | Strauss et al. | 362/539 |

* cited by examiner

*Primary Examiner*—Alan Cariaso
*Assistant Examiner*—Ismael Negron
(74) *Attorney, Agent, or Firm*—Brinks Hofer Gilson & Lione

(57) ABSTRACT

A light shield is adapted to be mounted within a headlamp assembly and includes a shield portion having an inner surface and an outer surface and a support portion which is adapted to mount the shield portion within a headlamp assembly. The outer surface of the shield portion has a decorative finish and the inner surface of the shield portion has a reflective finish, which is adapted to reflect light back within the headlamp assembly into which the light shield is mounted.

21 Claims, 1 Drawing Sheet

LIGHT SHIELD WITH REFLECTIVE INNER SURFACE

TECHNICAL FIELD OF THE INVENTION

The present invention generally relates to a light shield for a headlamp assembly which is adapted to block light from traveling directly outward from a light bulb mounted within the headlamp assembly.

BACKGROUND OF THE INVENTION

Shields are commonly used in headlamp assemblies to keep light rays from traveling directly outward from the bulb within a headlamp assembly. The light shield allows only the light reflected from the reflector of the headlamp assembly to travel outward from the headlamp assembly. This allows the shape and intensity of the beam coming from the headlamp to be controlled by appropriately designing the reflector, and also cuts down on the amount of glare caused by stray light rays. However, the light that is blocked by the shield is conventionally lost. Therefore, there is a need for an improved light shield for a headlamp assembly.

DETAILED DESCRIPTION OF THE INVENTION

Figure 1:
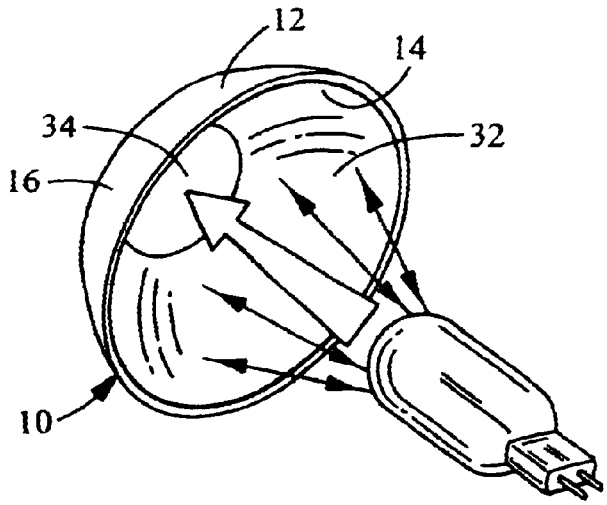
FIG. 1 is a perspective view of a light shield of the present invention.

The following description of the preferred embodiment of the invention is not intended to limit the scope of the invention to this preferred embodiment, but rather to enable any person skilled in the art to make and use the invention.

Referring to the figures, a light shield adapted to be mounted within a headlamp assembly is shown generally at 10. The light shield 10 includes a shield portion 12 having an inner surface 14 and an outer surface 16 and a support portion 18. The support portion 18 may be adapted to mount the light shield 10 and the lamp 26 within a headlamp assembly 24. Preferably, the support portion 18 comprises a leg 20 extending down from the shield portion 12 and is attached to a reflector of the headlamp assembly 24. The leg 20 can be mounted to the headlamp assembly 24 by any suitable means.

The outer surface 16 of the shield portion 12 has a decorative finish and the inner surface 14 of the shield portion 12 has a reflective finish. The reflective finish of the inner surface 14 of the shield portion 12 is adapted to reflect light that strikes the inner surface 14 back into the headlamp assembly 24 in which the shield 10 is mounted.

The inner surface 14 of the light shield 12 presents a generally concave spherical surface. The spherical shape of the inner surface 14 will have a focal point 22 50 that light striking the inner surface 14 of the light shield 12 will be reflected back to the focal point 22.

Figure 2:
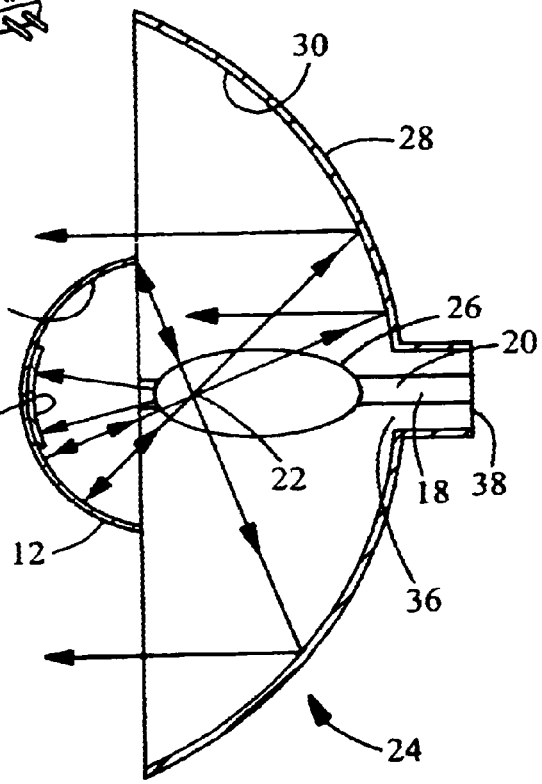
FIG. 2 is a sectional view of a light assembly with a light shield of the present invention.

Referring to FIG. 2, a headlamp assembly 24 including the light shield of the present invention is shown. The headlamp assembly 24 includes a light source 26 and a reflector 28. Preferably, the reflector 28 has a concave parabolic shape, however the shape of the reflector 28 can be any shape that is suitable for a particular application. Further, the reflector 28 has a reflective inner surface 30. The light source 26 is supported within the reflector 28 such that light from the light source 26 is reflected outward into a controlled beam pattern. The beam pattern is controlled by the shape of the reflector 28.

The inner surface 14 of the shield portion 12 will reflect light from the light source 26 back through the light source 26 to the reflector 28 to be reflected as part of the beam pattern. The inner surface 14 is a spherical and concave surface, and the light shield 10 is mounted within the headlamp assembly 24 such that the focal point 22 of the inner surface 14 is coincident with the light source 26. Light from the light source 26 that is reflected back from the inner surface 14 of the shield portion 12 is reflected directly back through the light source 26.

Therefore, any light that is reflected from the inner surface 14 of the shield portion 12 will travel back through the light source 26 and hit the inner surface 30 of the reflector 28 at the same angle that the light coming directly from the light source 26 hits the inner surface 30 of the reflector 28. In this way, light that would normally be lost to the light shield 10 is re-captured and utilized just as the light that initially hits the reflector 28. The additional light does not affect the beam pattern, because the light reflected by the light shield 10 hits the reflector 28 at the same angle, and therefore falls exactly within the controlled beam pattern and adds light intensity to the beam.

The inner surface 14 of the shield portion 12 includes a reflective zone 32 and a dead zone 34. The reflector 28 includes an opening 36 to allow the light source 26 to be mounted within the reflector 28. Some of the light that is reflected from the inner surface 14 of the shield portion 12 will be reflected back through the light source 26 either into the opening 36 or into a base portion 38 of the light source 26. This light will not be reflected by the reflector 28, and is therefore lost. Therefore, the inner surface 14 of the shield portion 12 includes the dead zone 34 from which any reflected light is useless.

Because any light reflected from the dead zone 34 is useless, preferably the portion of the inner surface 14 within the dead zone 34 does not have a reflective surface. Additionally, since the dead zone 34 is not being used to reflect light back to the reflector 28, the shape of the portion of the inner surface 14 within the dead zone 34 is not required to have a concave spherical shape. Therefore, only the reflective zone 32 portion of the inner surface 14 of the shield portion 12 of the light shield 10 must have a reflective surface and present a concave spherical shape.

Figure 3:
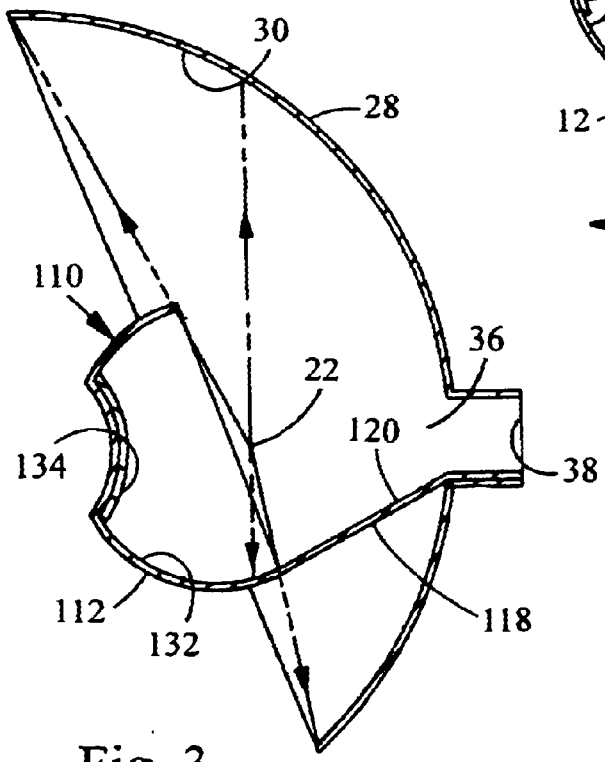
FIG. 3 is a sectional view of a light assembly with an alternative light shield.

As shown in FIG. 3, the shape and surface of the dead zone 134 can be made to the specifications of a particular application. Although the dead zone 134 shown in FIG. 3 is not spherical and concave, the reflective tone 132 of the shield portion 112 is spherical and concave. The support portion 118 shown in FIG. 3 may be adapted to mount the light shield 110 within the headlamp assembly 24 even if the support portion 118 is not used to mount the lamp 26. The support portion 118 preferably comprises a leg 120.

Preferably, the decorative outer surface 16 of the shield portion of the light shield 10 has a reflective surface which matches the reflective surface of the reflector 28. This will provide a cosmetically appealing appearance for the headlamp assembly 24 by making the light shield 10 virtually invisible against the reflector 28. The outer surface 16 of the shield portion 12 of the light shield 10 could, however, be of any suitable surface finish required for the particular application.

Preferably, the light source is a conventional filament type light bulb which is commonly used in the industry, however it is to be understood that any suitable type of light source could be used with the present invention with similar results.

The foregoing discussion discloses and describes one preferred embodiment of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

We claim:

1. A headlamp assembly comprising:

a light source;

a reflector having a reflective surface adapted to reflect light from said light source outward from said headlamp assembly in a beam pattern; and a light shield coupled to said reflector and adapted to prevent light emitted from said light source from projecting directly outward from said headlamp assembly, whereby the beam pattern consists of only light reflected from said reflector, said light shield including a shield portion and a support portion;

said support portion coupling said shield portion with said reflector;

said shield portion having an outer surface and an inner surface, said inner surface having a reflective zone and a dead zone, said reflective zone including a reflective finish and presenting a concave spherical surface having a focal point, said reflective finish adapted to reflect light from said light source to said reflector such that light reflected from said inner surface of said shield portion is reflected from said reflector as part of the beam pattern.

2. The headlamp assembly of claim 1 wherein said outer surface of said shield portion has a reflective surface matching the reflective surface of said reflector.

3. The headlamp assembly of claim 1 wherein said light source is a light bulb.

4. The headlamp assembly of claim 1 wherein said reflector presents a generally concave parabolic shape.

5. The headlamp assembly of claim 1 wherein said dead zone includes a non reflective finish.

6. The headlamp assembly of claim 1 wherein said outer surface of said shield portion has a decorative finish.

7. The headlamp assembly of claim 6 wherein said decorative finish of said outer surface of said shield portion has a reflective surface matching the reflective surface of said reflector.

8. A light shield adapted to be mounted within a headlamp assembly comprising:

a shield portion having an inner surface and an outer surface;

a support portion adapted to couple said shield portion to a headlamp assembly;

said inner surface of said shield portion including a reflective zone and a dead zone, said reflective zone including a reflective finish adapted to reflect light back within the headlamp assembly.

9. The light shield of claim 8 wherein said dead zone includes a non reflective finish.

10. The light shield of claim 8 wherein said outer surface of said shield portion has a decorative finish.

11. The light shield of claim 8 wherein said reflective zone presents a concave spherical surface.

12. The light shield of claim 11 wherein said concave spherical surface has a focal point, whereby light emitted from said focal point that hits said spherical surface is reflected back to said focal point.

13. A headlamp assembly comprising:

a light source;

a reflector having a reflective surface adapted to reflect light from said light source; and a light shield coupled with said reflector and having an outer surface and an inner surface, said inner surface including a reflective zone and a dead zone, said reflective zone including a reflective finish adapted to reflect light from said light source to said reflector, and said dead zone including a non reflective finish.

14. The headlamp assembly of claim 13 wherein said light shield includes a shield portion and a support portion, said support portion coupling said shield portion with said reflector.

15. The headlamp assembly of claim 13 whereby said beam pattern consists of only light reflected from said reflector.

16. The headlamp assembly of claim 13 wherein said light shield is coupled with said reflector to prevent light emitted from said light source from projecting directly outward from said headlamp assembly, and to permit light emitted from said light source to be reflected from said headlamp assembly as part of a beam pattern.

17. The headlamp assembly of claim 13 wherein said reflector presents a generally concave parabolic shape.

18. The headlamp assembly of claim 13 wherein said outer surface of said shield portion has a decorative finish.

19. The headlamp assembly of claim 18 wherein said decorative finish of said outer surface of said shield portion has a reflective surface matching the reflective surface of said reflector.

20. The headlamp assembly of claim 13 wherein said reflective zone presents a concave spherical surface.

21. The headlamp assembly of claim 20 wherein said concave spherical surface has a focal point and said light shield is positioned within said headlamp assembly such that said focal point is coincident with said light source, whereby light from said light source that is reflected back from said inner surface of said light shield is reflected directly back through said light source and onto said reflector.

* * * * *

UNITED STATES PATENT AND TRADEMARK OFFICE

CERTIFICATE OF CORRECTION

PATENT NO. : 6,641,293 B2
DATED : November 4, 2003
INVENTOR(S) : Arun Kumar et al.

It is certified that error appears in the above-identified patent and that said Letters Patent is hereby corrected as shown below:

Column 3,
Line 47, delete “non reflective” and substitute -- nonreflective -- in its place.

Column 4,
Line 8, delete “non reflective” and substitute -- nonreflective -- in its place.
Line 26, delete “non reflective” and substitute -- nonreflective -- in its place.

Signed and Sealed this

Twentieth Day of April, 2004

JON W. DUDAS
*Acting Director of the United States Patent and Trademark Office*